US007434525B2

(12) United States Patent
Hodge

(10) Patent No.: US 7,434,525 B2
(45) Date of Patent: Oct. 14, 2008

(54) SUSPENSION SYSTEM FOR A BOAT

(76) Inventor: Christopher Graham Hodge, 20 Holmbury Park, Bromley, Kent (GB) BR1 2QS ( * ) Notice: Subject to any disclaimer, the term of this patent is extended or adjusted under 35 U.S.C. 154(b) by 0 days.

(21) Appl. No.: 11/664,166

(22) PCT Filed: Sep. 29, 2005

(86) PCT No.: PCT/GB2005/003737

§ 371 (c)(1),
(2), (4) Date: Mar. 29, 2007

(87) PCT Pub. No.: WO2006/035229

PCT Pub. Date: Apr. 6, 2006

(65) Prior Publication Data

US 2007/0261625 A1 Nov. 15, 2007

(30) Foreign Application Priority Data

Sep. 30, 2004 (GB) ..... 0421756.8

(51) Int. Cl.
*B63B 29/02* (2006.01)

(52) U.S. Cl. ..... 114/71

(58) Field of Classification Search ..... 114/71, 114/363

See application file for complete search history.

(56) References Cited

U.S. PATENT DOCUMENTS 3,042,392 A * 7/1962 Schmitz et al. ..... 280/124.102
3,603,575 A * 9/1971 Arlasky et al. ..... 267/34
5,207,408 A * 5/1993 Burg ..... 248/550
6,176,190 B1 1/2001 Ozga
6,182,596 B1 2/2001 Johnson
6,763,774 B1 7/2004 Ranieri et al.
2004/0024503 A1 2/2004 Swinbanks et al.

FOREIGN PATENT DOCUMENTS

EP 0285007 A * 3/1988
FR 2746763 10/1997
JP 01136890 A * 5/1989
JP 03050093 A * 3/1991

* cited by examiner

*Primary Examiner*—Ed Swinehart
(74) *Attorney, Agent, or Firm*—Iandiorio Teska & Coleman

(57) ABSTRACT

A suspension system (2) for a boat (4), which suspension system (2) is for mounting to a hull (6) of the boat (4), and which suspension system (2) comprises a single accommodation unit (8) for at least one person travelling on the boat (4), and suspension means (10) for providing suspension for the accommodation unit (8) with respect to the hull (6) of the boat (4), and the suspension system (2) being such that is prevents or reduces shocks to the hull (6) caused by the boat (4) travelling through the water from being transmitted to the accommodation unit (8), and the suspension system (2) being such that is enables weight transfer between the accommodation unit (8) and the hull (6) for enhancing handling and ride characteristics of the boat (4).

18 Claims, 24 Drawing Sheets

SUSPENSION SYSTEM FOR A BOAT

This invention relates to a suspension system and, more especially, this invention relates to a suspension system for a boat.

Persons travelling on boats often find the boats uncomfortable in all weather conditions except those which are very calm. This applies especially to small boats. In rough sea conditions, high shock loads to the hull of a boat can be transferred to the persons travelling on the boat, causing potential damage to knees, necks, internal organs and backs of the persons.

It is an aim of the present invention to reduce the above mentioned problem.

Accordingly, the present invention provides a suspension system for a boat, which suspension system is for mounting to a hull of the boat, and which suspension system comprises a single accommodation unit for at least one person travelling on the boat, and suspension means for providing suspension for the accommodation unit with respect to the hull of the boat; the suspension system being such that it prevents or reduces shocks to the hull caused by the boat travelling through the water from being transmitted to the accommodation unit; the suspension system being such that enables weight transfer between the accommodation unit and the hull for enhancing handling and ride characteristics of the boat; and the suspension system being such that it comprises at least one joint arrangement which allows rotational and vertical movement and which comprises first pivot means for securing to the hull, second pivot means for securing to the accommodation unit, third pivot means positioned between the first and the second pivot means, a first member which is of a fixed length and which extends between the first and the third pivot means, and a second member which is of a fixed length and which extends between the second and the third pivot means.

A person or persons in the accommodation unit of the boat is thus protected by the suspension system from shock loads to the hull. The person or persons are therefore able to travel with a reduced risk of damage to their knees, necks, internal organs and back. In addition, because the person or persons travelling on the boat are in the accommodation unit, they are able to be considered as a single mass. This in turn allows the weight transfer between the accommodation unit and the hull, whereby the handling and ride characteristics of the boat are able to be enhanced. Thus, for example, the accommodation unit can be accurately inclined during turning of the boat, and thereby to facilitate fast and safe turning of the boat.

The suspension system may include electronic control means for controlling operation of the suspension means. The electronic control means may comprise sensor means for sensing dynamic forces on the hull, and computer means for receiving input signals derived from the sensed dynamic forces and for providing response signals for the suspension means in order to cause the suspension means to provide optimum ride conditions for the person when the boat is travelling through the water. The sensor means may be a potentiometer or it may be a gyroscope sensor means. The potentiometer may be a sliding potentiometer.

The suspension means may comprise front suspension means and rear suspension means.

The front suspension means may comprise at least one front shock absorbing device for permitting up and down movement of the accommodation unit and absorbing up and down shocks, and a multi-axis joint for permitting side to side movement of the accommodation unit and thereby absorbing sideways shocks.

Preferably, the front shock absorbing device is an airbag. Other types of front shock absorbing device may however be employed so that, for example, the front shock absorbing device may be a hydraulic device or a spring such for example as a coil spring.

The front shock absorbing device may extend at an angle to the vertical. The front shock absorbing device may however extend vertically if desired.

There may be two of the front shock absorbing devices, there being one of the front shock absorbing devices on either side of the accommodation unit.

The multi-axis joint is preferably a double joint. Other types of multi-axis joint may however be employed.

The rear suspension means may comprise at least one rear shock absorbing device.

The rear shock absorbing device is preferably an air bag. Other types of rear shock absorbing device may however be employed so that, for example, the rear shock absorbing device may be a hydraulic device or a spring such for example as a coil spring.

The rear shock absorbing device may extend substantially vertically. The rear shock absorbing device may extend at any desired angle.

The rear shock absorbing device may be connected directly to the hull.

There may be two of the rear shock absorbing devices, there being one of the rear shock absorbing devices on either side of the accommodation unit.

The suspension system may be of a modular construction for enabling a plurality of units of the suspension system to be connected together.

The suspension system may include means for raising and lowering the accommodation unit. This raising and lowering may be employed for docking purposes, rescue purposes or search purposes.

The above mentioned electronic control means may enable adjustment of the accommodation unit with respect to the hull in dependence upon water conditions and/or boat engine conditions. The electronic control means may operate an actuator for causing movement of the accommodation unit relative to the hull. The electronic control means may comprise sensor means in the form of sensors appropriately installed on the boat and for sensing the load in the accommodation unit, the speed of the boat, and movement of the accommodation unit relative to the hull. The sensors may provide the sensed information to the computer means for determining appropriate control action. Thus, for example, control of the actuators may be effected for changing damping characteristics within milliseconds. Control of a pneumatic suspension system or a hydraulic suspension system may be accurately and precisely effected. Air spring struts may be employed with electrically adjustable dampers. Electronic air suspension enables fast and accurate control of the accommodation unit relative to the hull of the boat, which in turn is able to give better driving and safety characteristics for the boat. The electronic air suspension means may automatically adapt damping and spring characteristics to those appropriate for conditions at any moment. The electronic air suspension means may be able to reduce roll and pitch movements of the boat, and improve driving dynamics and comfort. Appropriate software information may form part of the electronic control means in order to provide optimum efficiency.

The electronic control means may measure unit mass movement using the sensor means, for example a sliding potentiometer. The electronic control means may control engine speed and/or the suspension in order to give a required boat travelling condition. The control means may include sensors determining different boat engine operating parameters. Inputs from the sensors will normally be applied to the computer means as appropriate electronic signals.

The electronic control means may be a closed loop electronic control means which senses conditions and which includes a feed back to the control means. The control means may accordingly act independently of the driver. Control values may be obtained which are equivalent to what is required to effect control of the motion of the boat.

The suspension system may include bump stops for providing a high spring rate for a last portion of travel of the suspension means relative to the hull and thereby to allow a lower spring rate for the remainder of the travel of the suspension means.

The suspension system may include springs which are variable rate springs. The variable rate springs can be made stiffer or softer throughout their range of travel. Alternatively, if desired, the springs may be linear springs.

The boat may be any suitable and appropriate type of boat. Thus, for example, the boat may be a speed boat, a rescue boat, a rigid boat, an inflatable boat, a motor boat, a sailing boat or a scooter. The boat may be for one or more persons.

Embodiments of the invention will now be described solely by way of example and with reference to the accompanying drawings in which.

Figure 21:
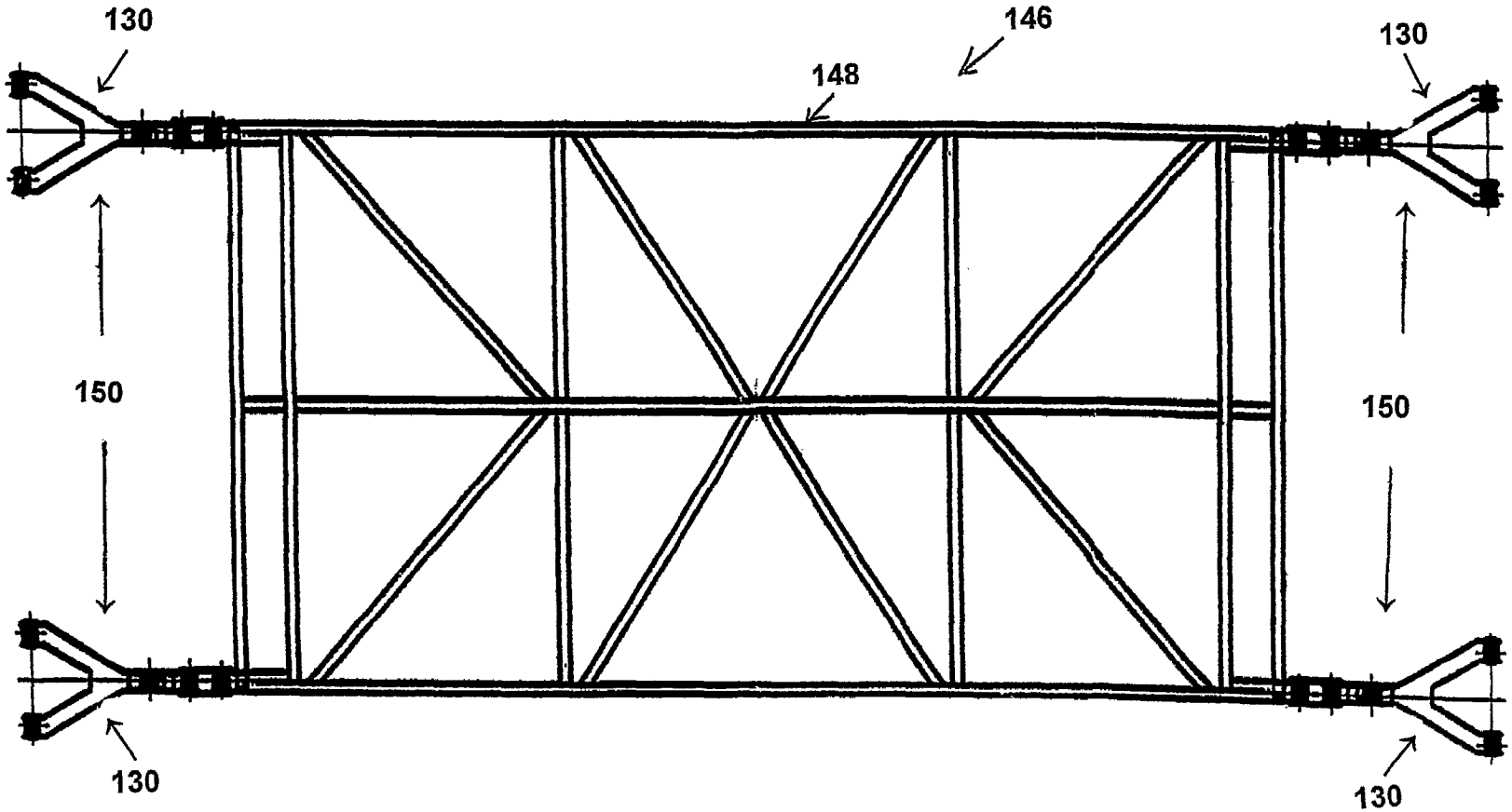
Figure 22:
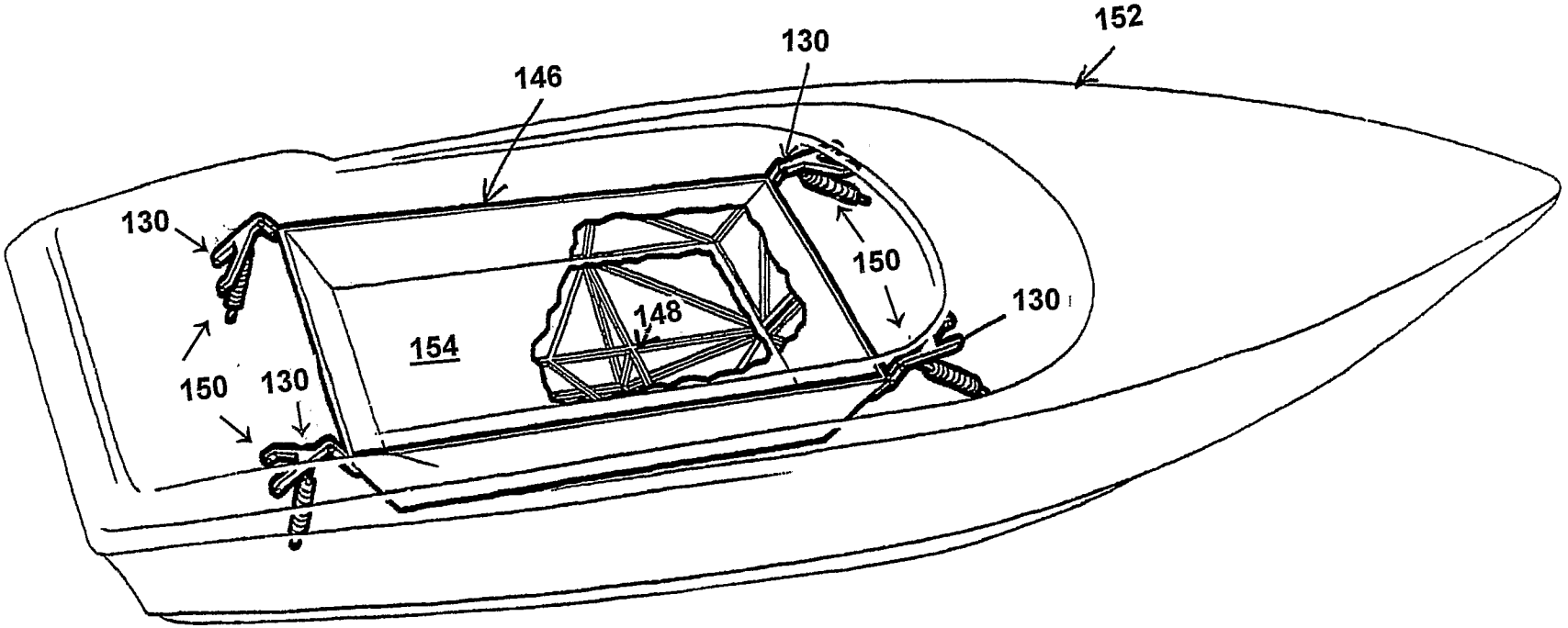
Figure 23:
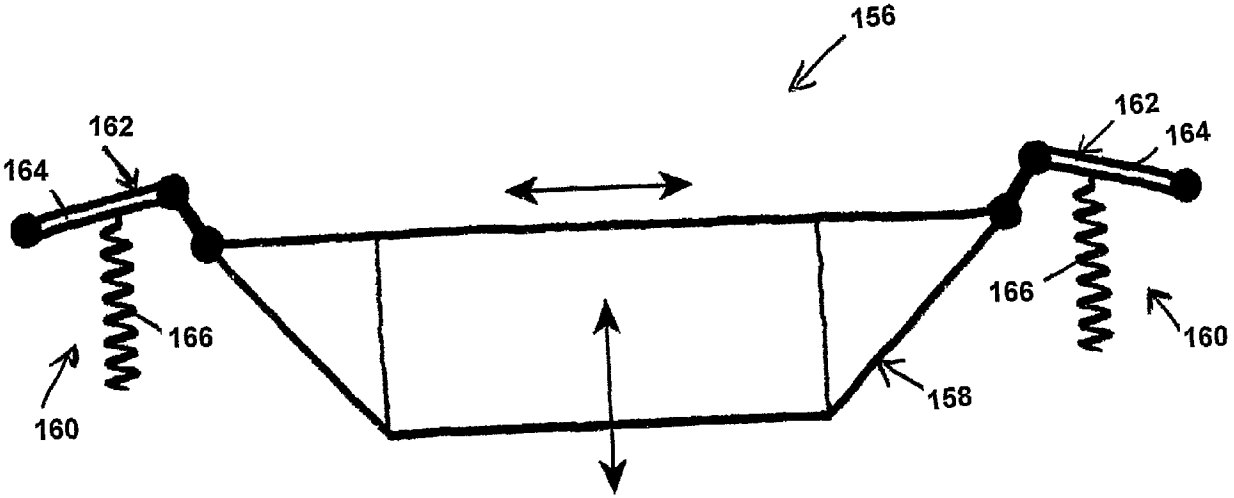
Figure 24:
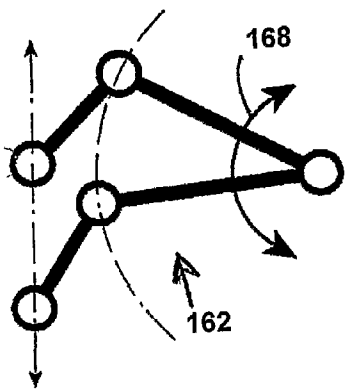
Figure 25:
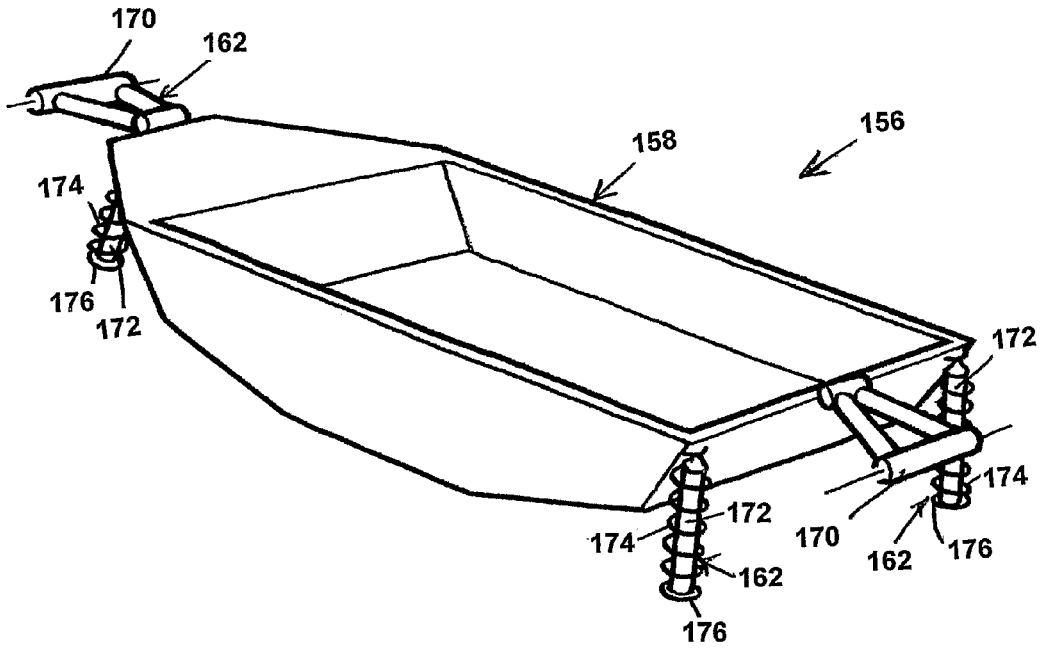
Figure 26:
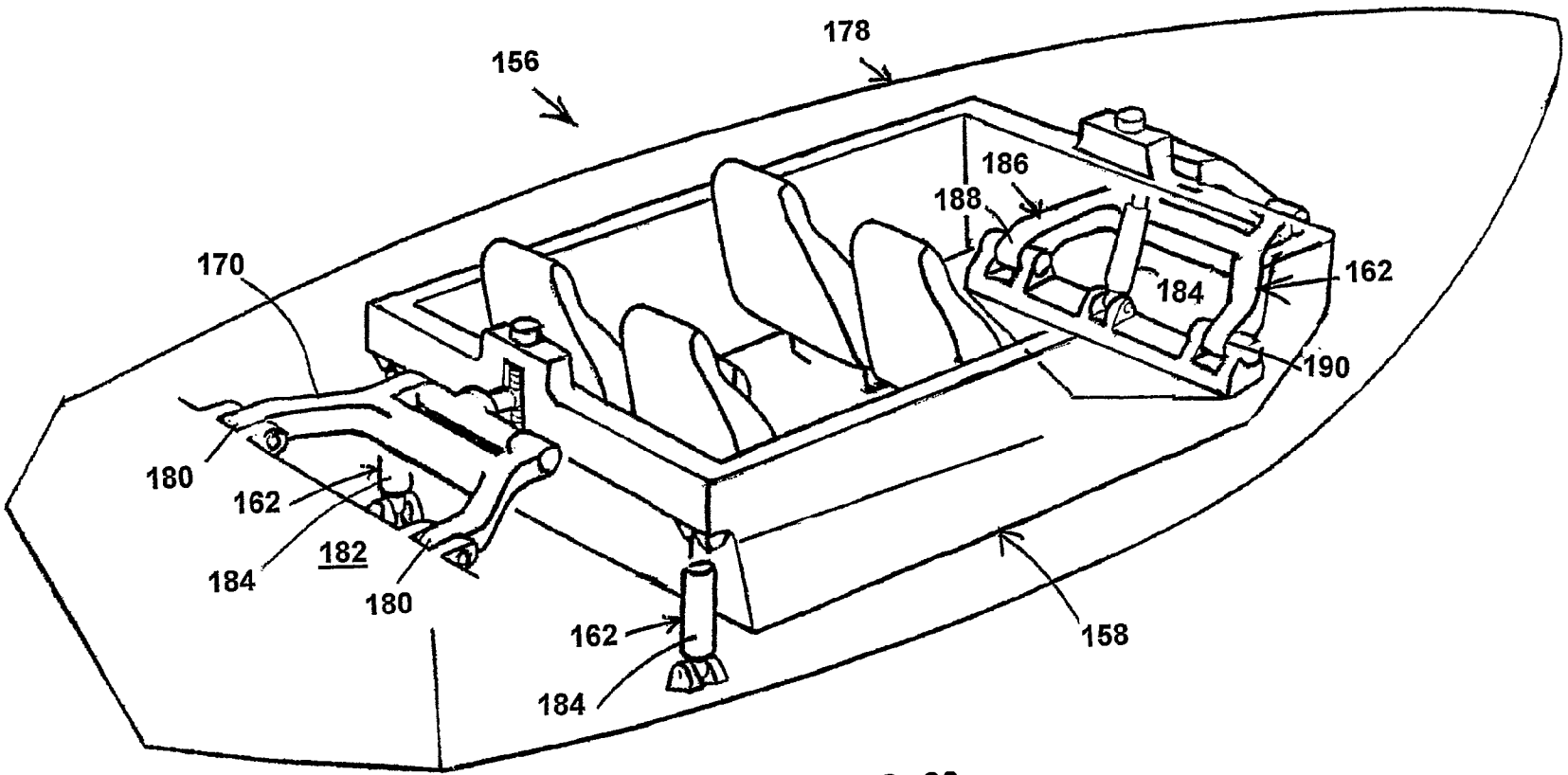
Figure 27:
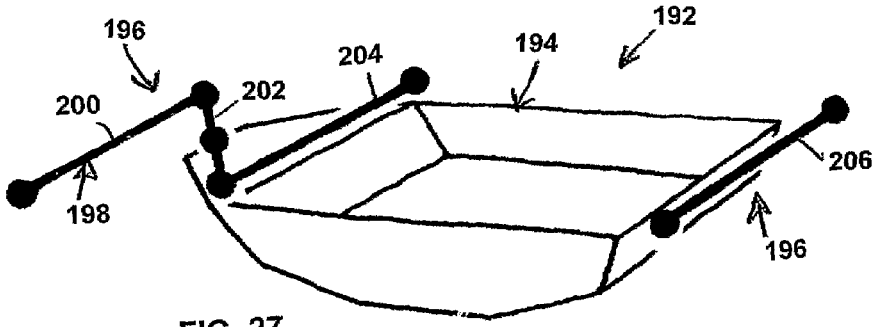
Figure 28:
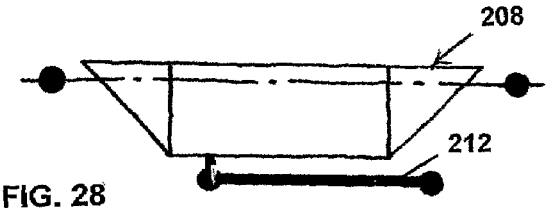
Figure 29:
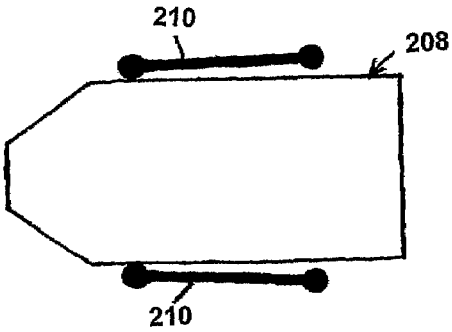
Figure 30:
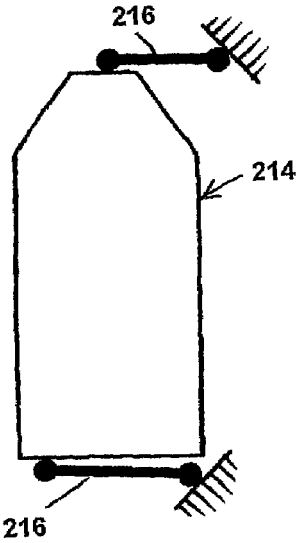
Figure 31:
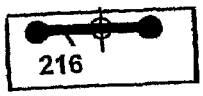
Figure 32:
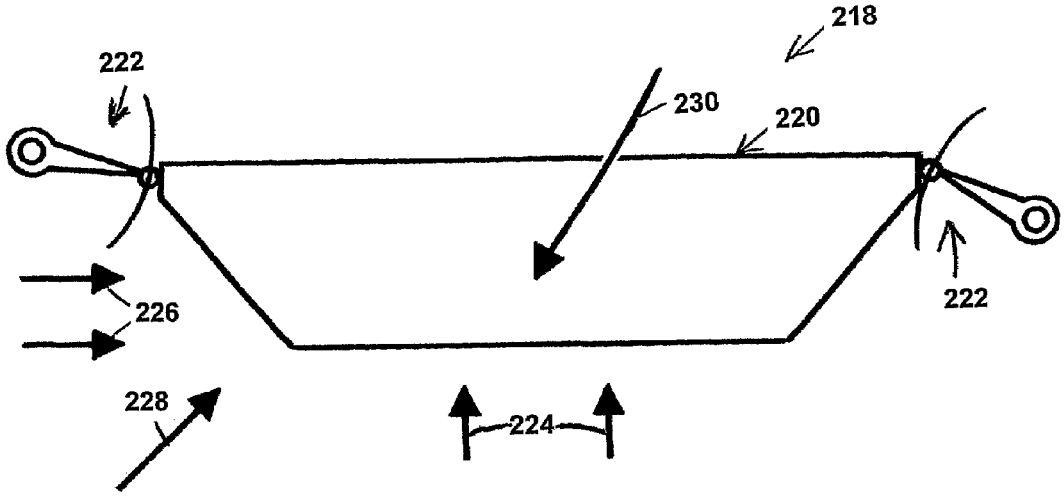
Figure 33:
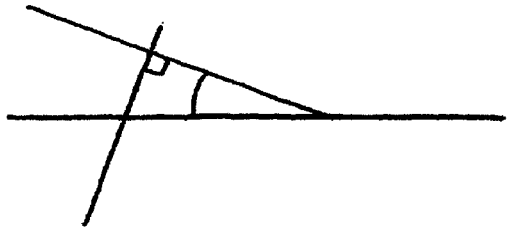
Figure 34:
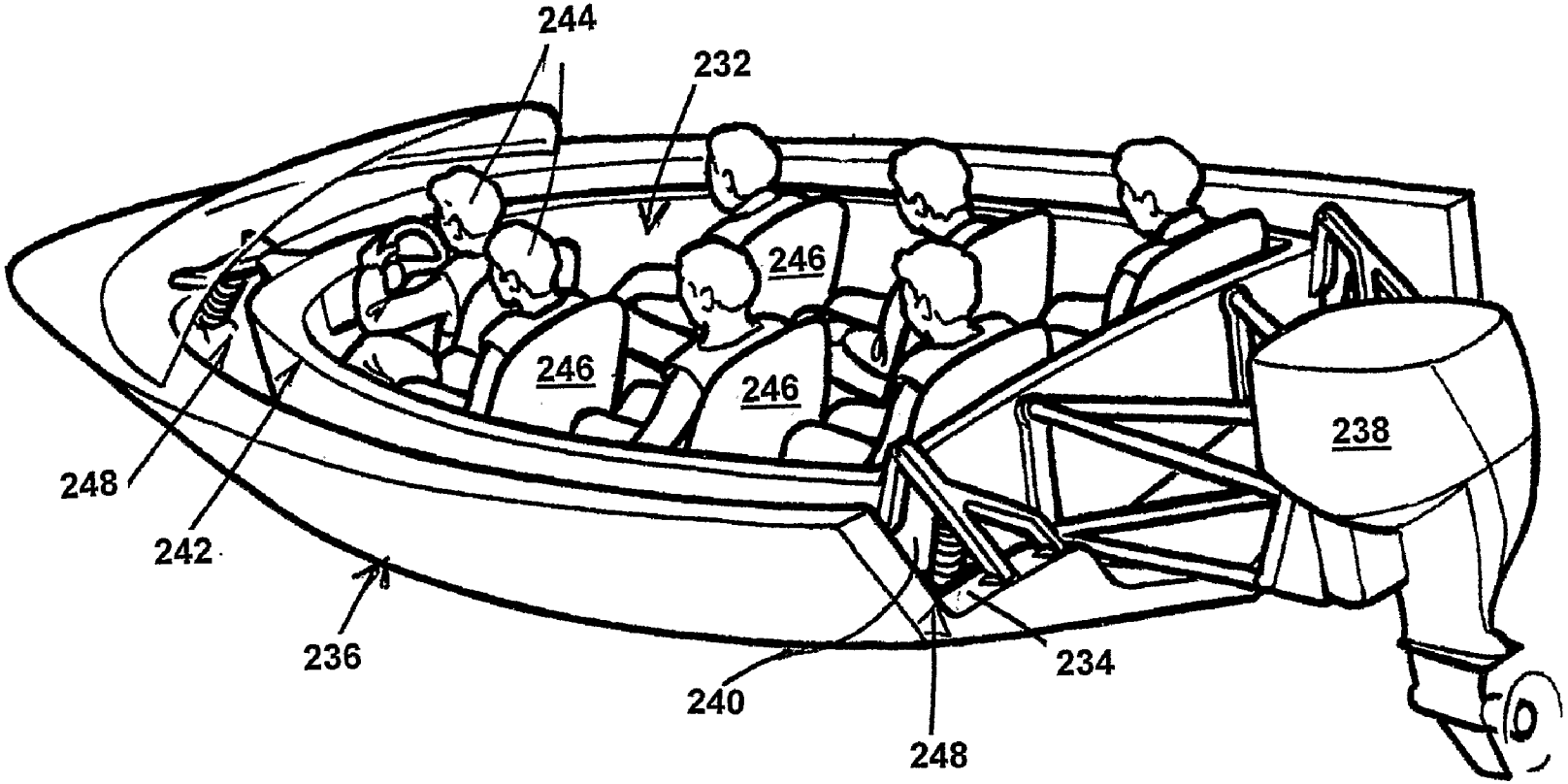
Figure 35:
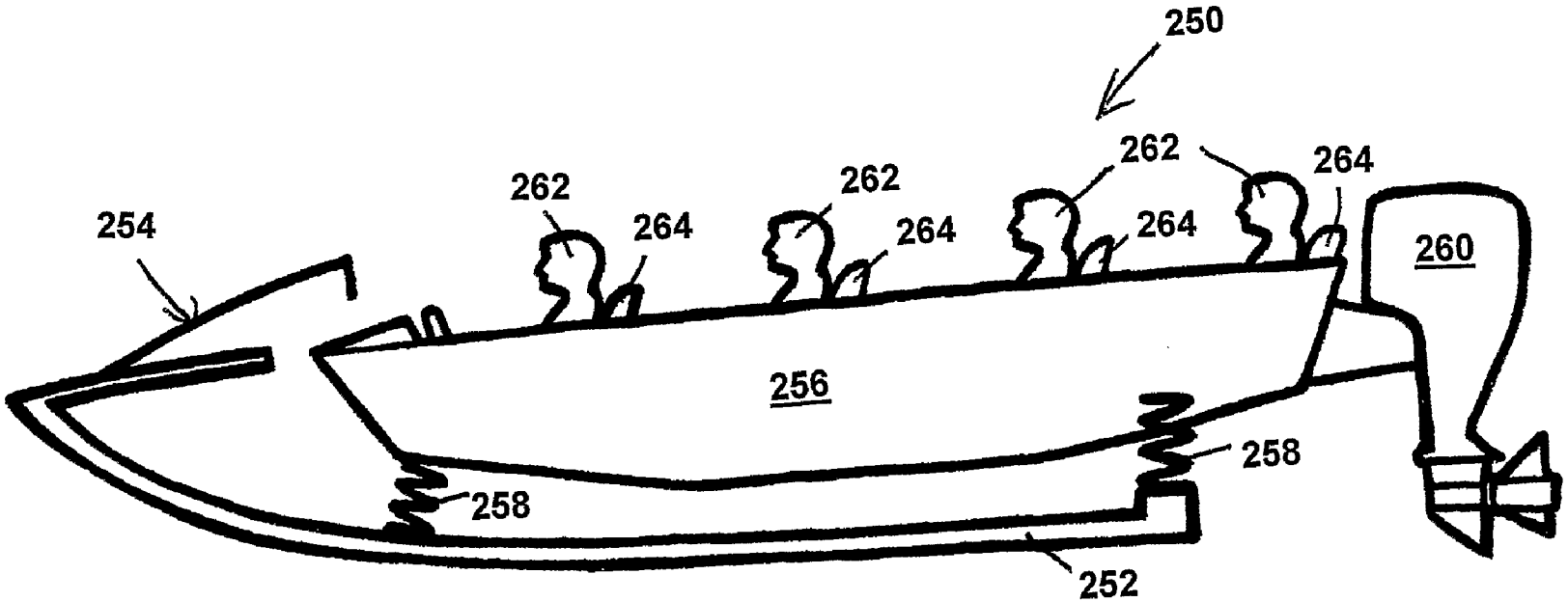
Figure 36:
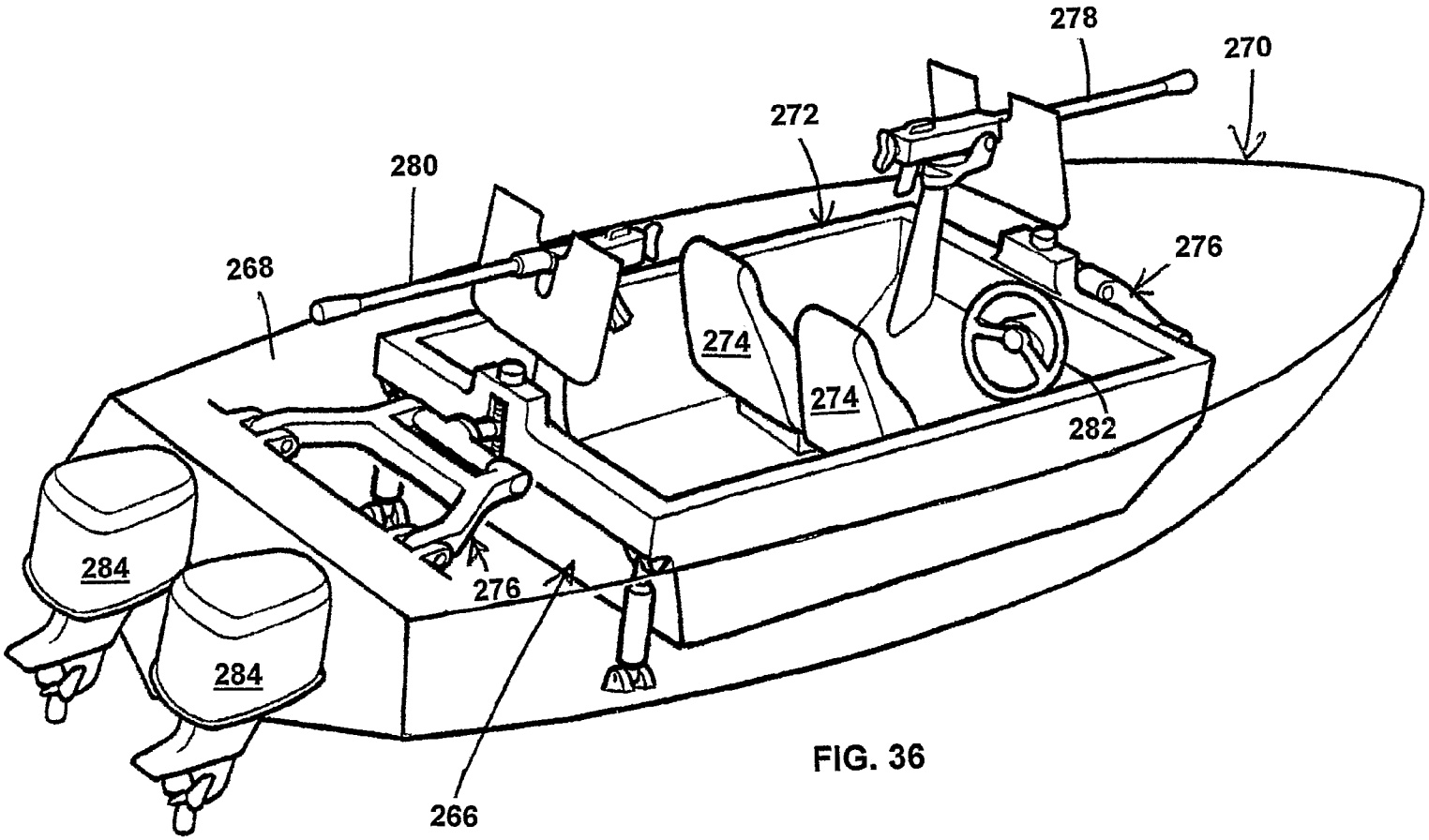
Figure 37:
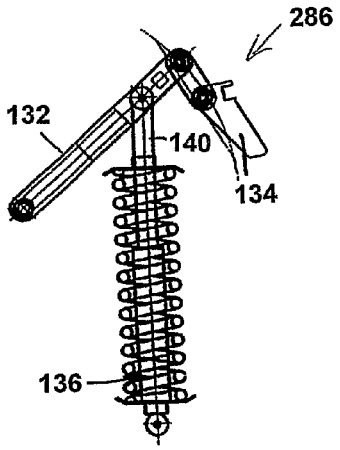
Figure 38:
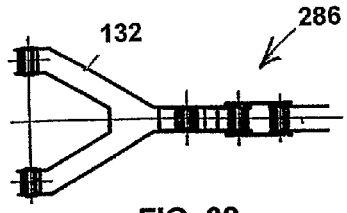
Figure 39:
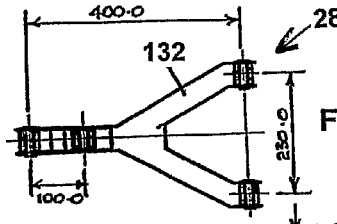
Figure 40:
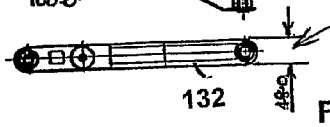

FIG. 21 a top plan view of an eighth suspension system for a boat;

FIG. 22 shows the suspension system of FIG. 21 installed in a boat;

FIG. 23 shows a ninth suspension for a boat;

FIG. 24 shows how the suspension system shown in FIG. 23 operates;

FIG. 25 shows a tenth suspension system for a boat;

FIG. 26 shows a boat having a suspension system of the general type shown in FIG. 25;

FIG. 27 shows an eleventh suspension system for a boat;

FIGS. 28 and 29 are side and top views of the suspension system shown in FIG. 27;

FIG. 30 is a top view of a twelfth suspension system for a boat, and is like the suspension system shown in FIG. 27 but with a modification;

FIG. 31 illustrates how the height of the centre of gravity may be changed in the suspension systems shown in FIGS. 27 and 30;

FIG. 32 is a side view showing a thirteenth suspension system for a boat;

FIG. 33 illustrates the angle of attack achieved by the suspension system shown in FIG. 32;

FIG. 34 shows a boat provided with a fourteenth suspension system;

FIG. 35 shows a boat provided with a fifteenth suspension system;

FIG. 36 shows a boat provided with a sixteenth suspension system; and

FIGS. 37-41 shows parts of a seventeenth suspension system for a boat.

Referring to FIGS. 1-9, there is shown a suspension system 2 for a boat 4. The suspension system 2 is for mounting to a hull 6 of the boat 4.

The suspension system 2 comprises a single accommodation unit 8 for all persons travelling on the boat 4. The suspension system 2 also comprises suspension means 10 for providing suspension for the accommodation unit 8 with respect to the hull 6 of the boat 4. The suspension system 2 is such that it prevents or reduces shocks to the hull 6 caused by the boat 4 travelling through the water from being transmitted to the accommodation unit 8. The suspension means 10 also enables the accommodation unit 8 to be controlled in response to control inputs. Thus the persons travelling in the accommodation unit 8 on the boat 4 are able to be regarded and controlled as a single mass. This facilitates precise and accurate control of the people on the boat and therefore the handling of the boat.

The suspension means 10 comprises front suspension means 12 and rear suspension means 14.

The front suspension means 12 comprises a shock absorbing device 16 for permitting up and down movement of the accommodation unit 8 and thereby absorbing up and down shocks. The front suspension means 12 also comprises a multi-axis joint 18 for permitting side to side movement of the accommodation unit 8 and thereby for absorbing sideways shocks.

The front shock absorbing device 16 is an airbag. As can be seen from FIG. 3, the front shock absorbing device 16 extends at an angle to the vertical. The multi-axis joint 18 is a double joint having an axle 20 for permitting rotation in one plane, and an axle 22 for permitting rotation in another plane. The front shock absorbing device 16 is pivotally connected by a pivot 21 to the multi-axis joint 18. The pivot 21 locates in upstanding lugs 23 on the multi-axis joint 18. A pivot 19 (see FIG. 5) connects the shock absorbing device 16 to the accommodation unit 8.

Figure 6:
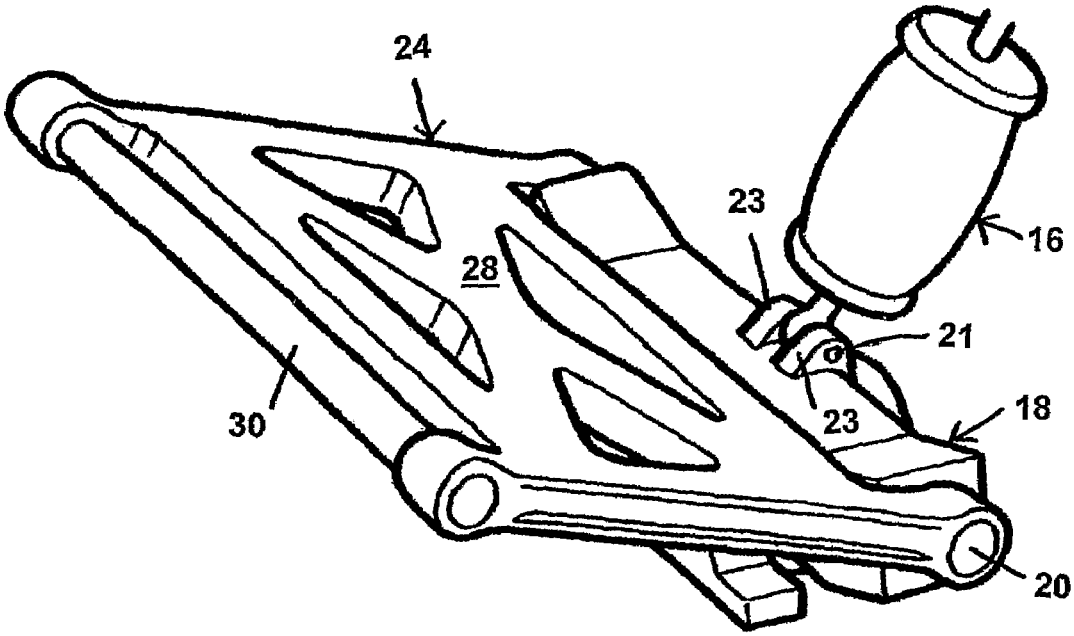
FIG. 6 is a view like FIG. 4 but without a top part of the front suspension means shown in FIG. 4.
Figure 8:
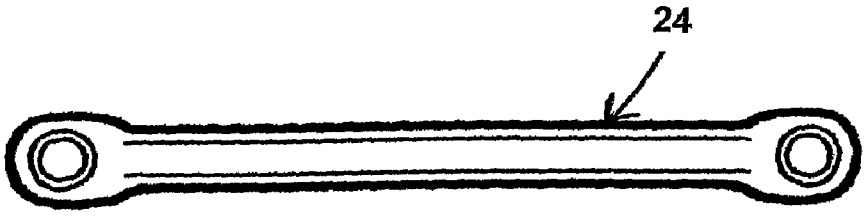
FIG. 8 is a side view of the part shown in FIG. 7.
Figure 7:
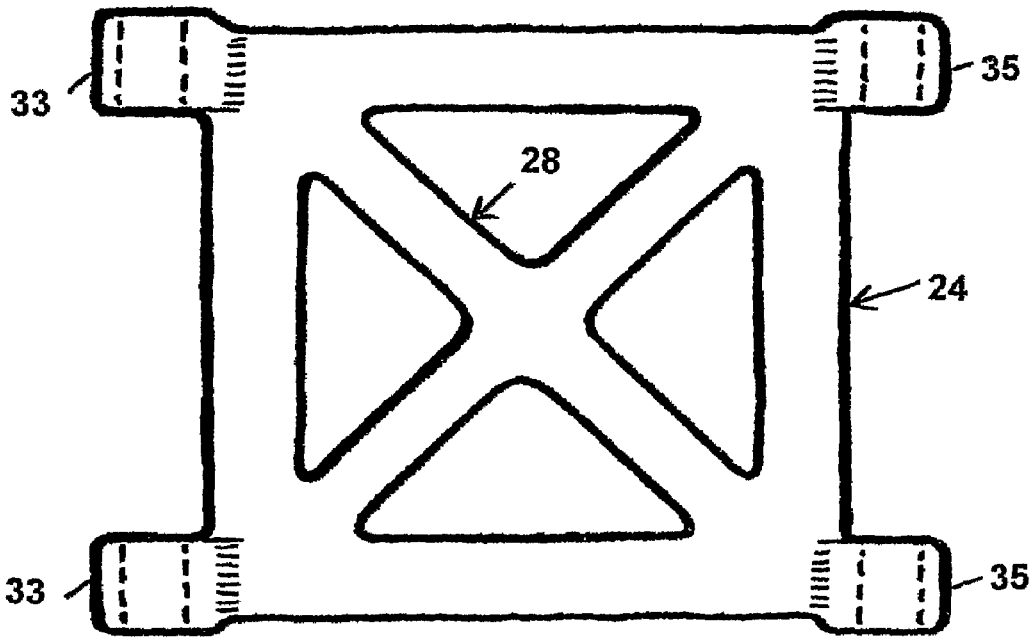
FIG. 7 is a top view of part of the front suspension means shown in FIG. 3.
Figure 9:
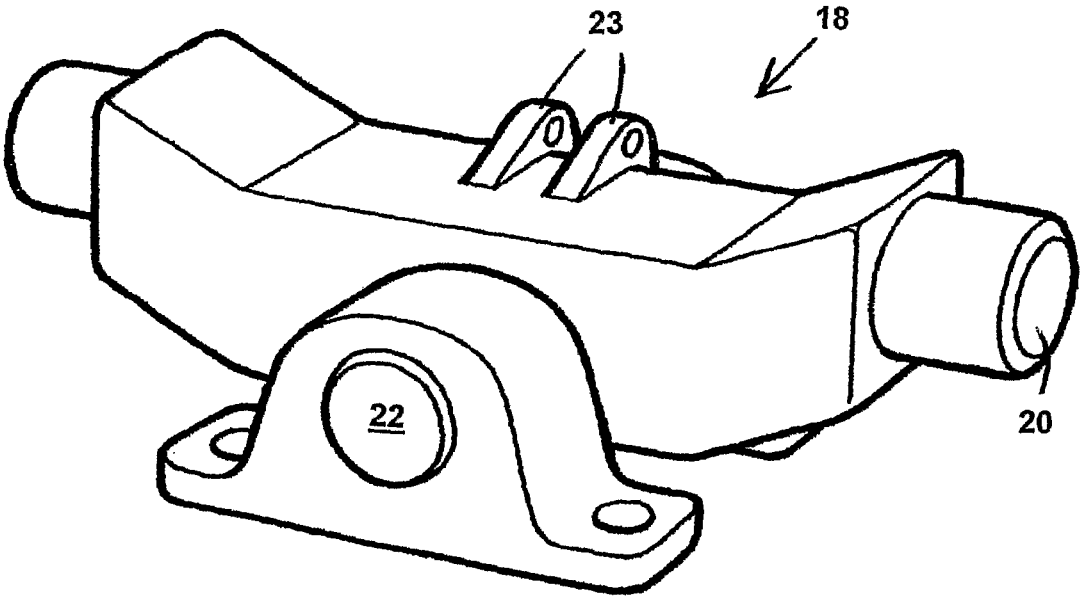
FIG. 9 is a view from the front and one side of part of the front suspension means shown in FIG. 3.

A suspension link member 24 extends from the multi-axis joint 18 to one end 25 of a front part 26 of the accommodation unit 8. The construction of the suspension link member 24 is best seen in FIGS. 6, 7 and 8. It will be seen that the suspension link member 24 comprises a cross formation 28 for providing rigidity. The suspension link member 24 is connected to the front part 26 of the accommodation unit 8 by an axle 30 locating in end formations 33 on the suspension link member 24. Similar formations receive the axle 20.

Figure 1:
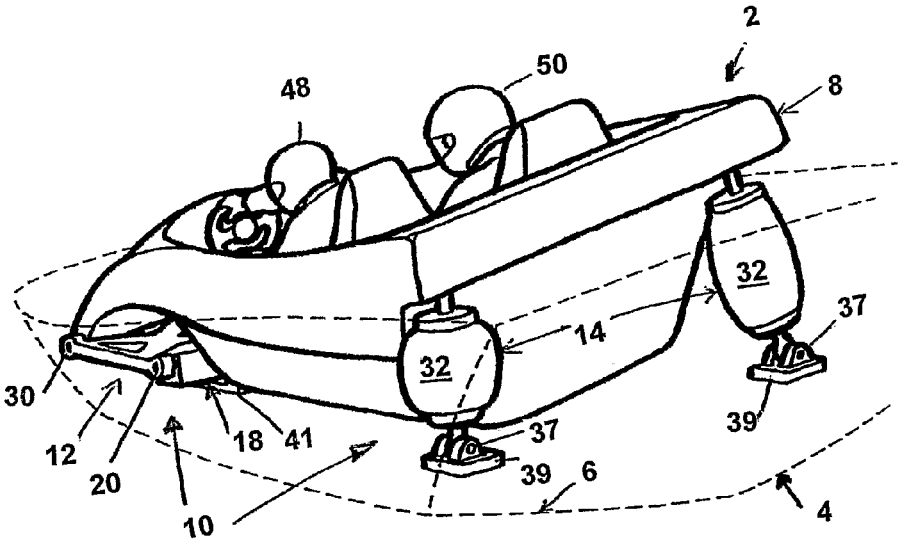
FIG. 1 is a view from the rear and one side of a first suspension system for a boat, with the boat being shown schematically.

The rear suspension means 14 comprises two rear shock absorbing devices 32. There is one of the rear shock absorbing devices 32 provided on each side of the accommodation unit 8. Each rear shock absorbing device 32 is in the form of an airbag. The rear shock absorbing devices 32 extend substantially vertically as shown in FIG. 1 when the accommodation unit 8 is horizontal.

The rear shock absorbing devices 32 are pivotally connected by pivots 37 to mounting plates 39. The multi-axis joint 18 has a mounting plate 41. The mounting plates 39, 41 are connected, for example by bolts or welding, directly to the hull 6 or via a platform (not shown) forming part of the suspension means 10. The connection can be effected by any suitable means, for example bolts.

Figure 10:
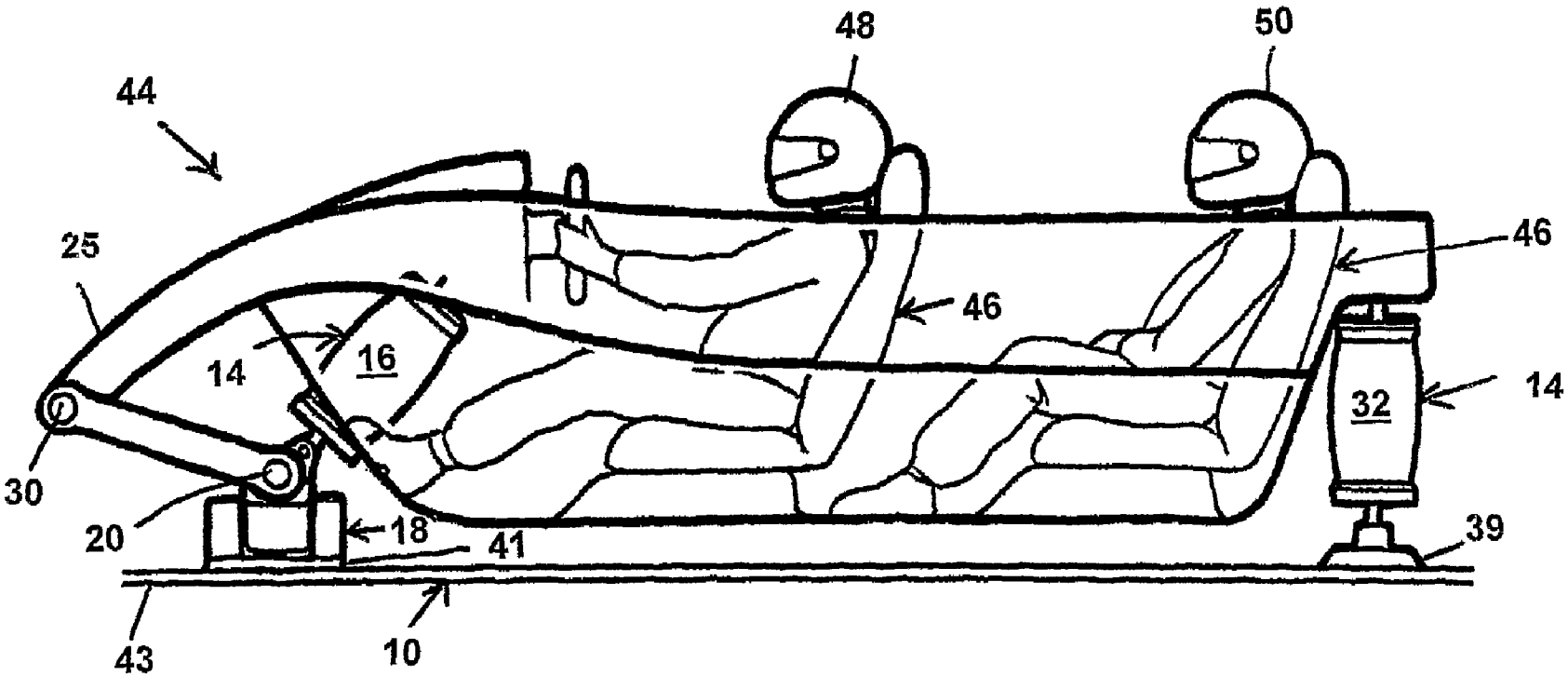
FIG. 10 is a side view of a second suspension system for a boat.

Referring now to FIG. 10, there is shown a suspension system 44. The suspension system 44 is similar to the suspension system 2 and similar parts have been given the same reference numerals for ease of comparison and understanding. In the accommodation unit 8 of the suspension system 2, there are shown two seats 46 arranged side by side. In the suspension system 44 shown in FIG. 10, there are shown two seats 46 arranged one behind the other. In both suspension systems 2, 44, one seat 46 is occupied by a driver 48 and the other seat 46 is occupied by a passenger 50.

Figure 11:
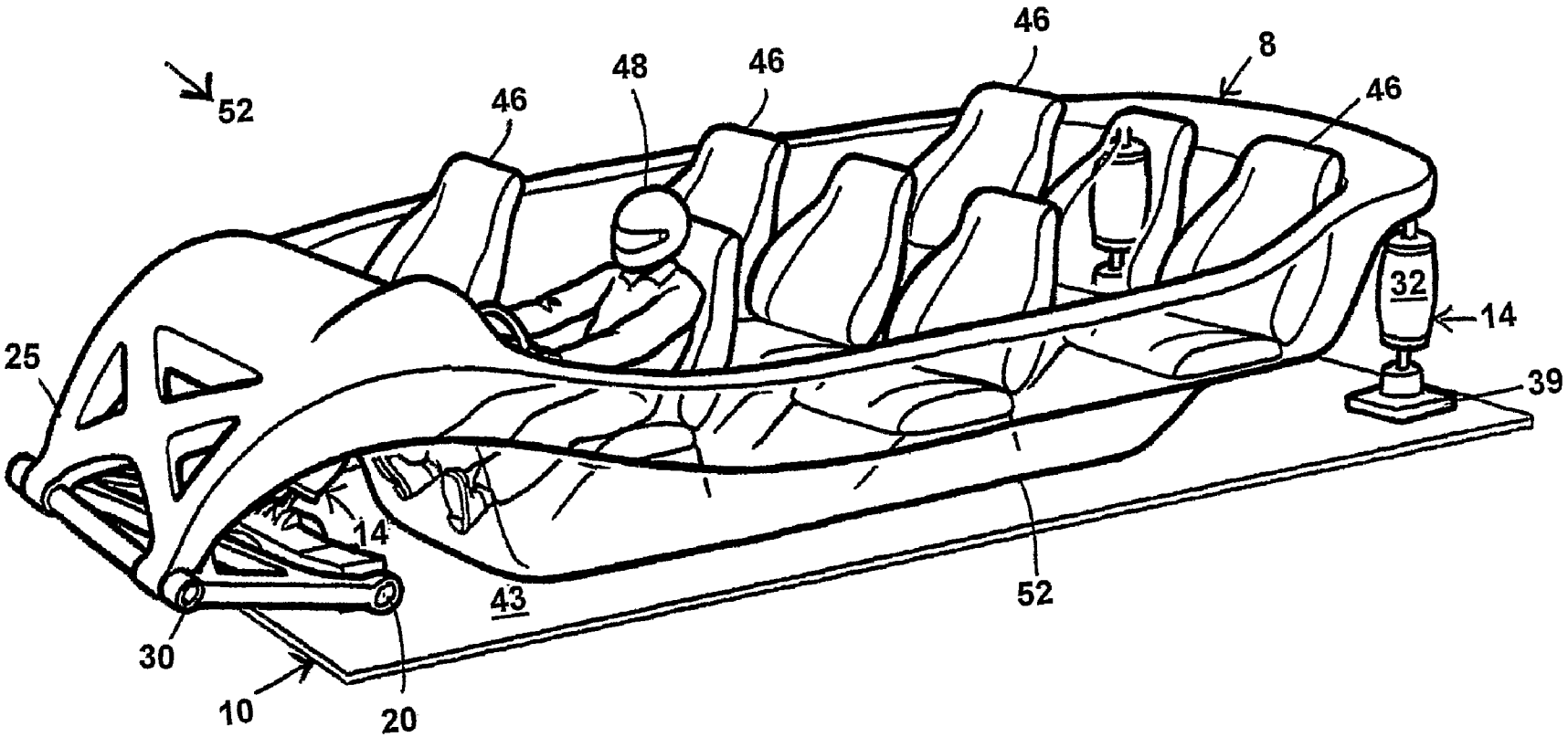
FIG. 11 is a perspective view a third suspension system for a boat.

FIG. 11 is a perspective view from the front and one side of a suspension system 52. Similar parts as in previous Figures have been given the same reference numerals for ease of comparison and understanding. In the suspension system 52, it will be seen that the accommodation unit 8 is large and it has eight seats 46.

Figure 12:
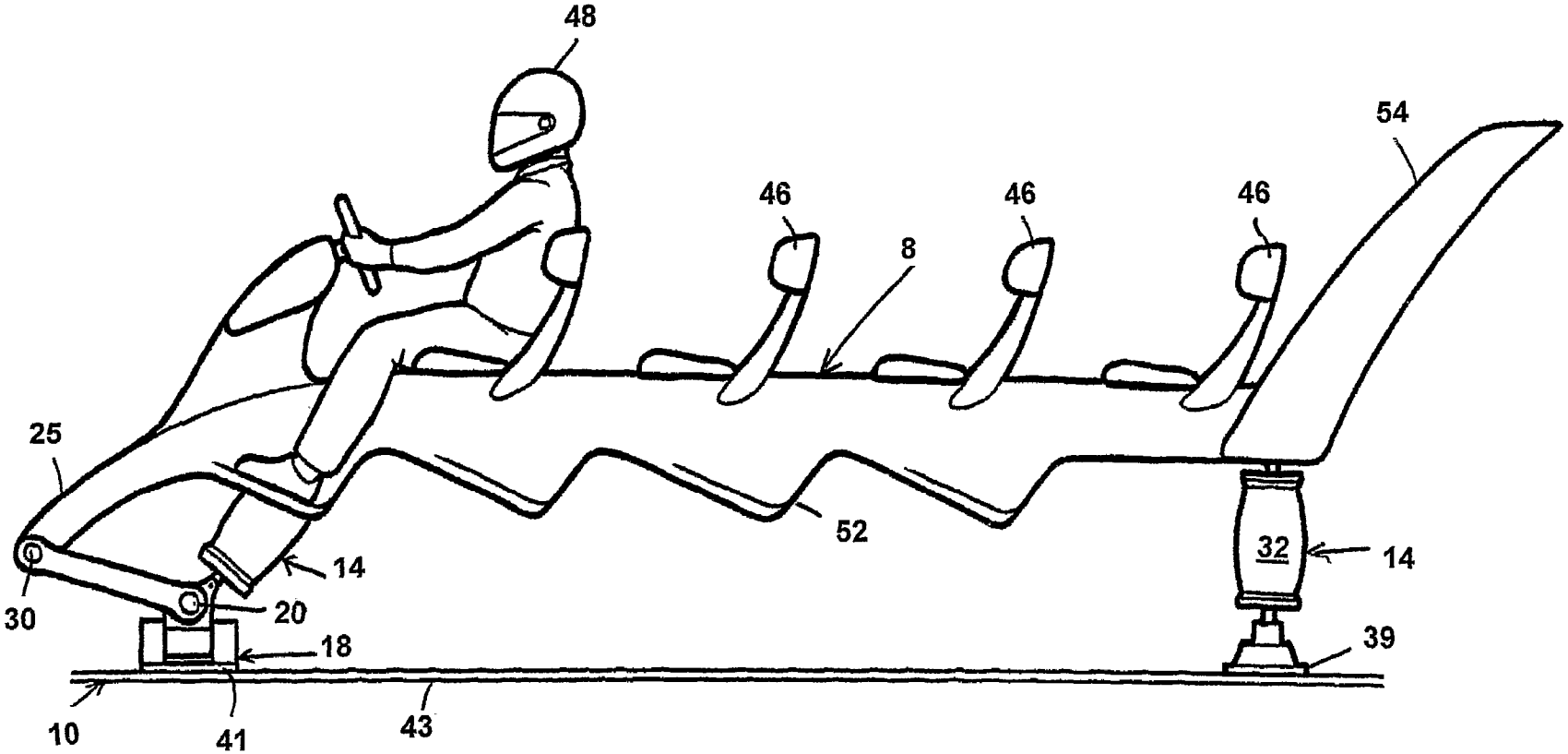
FIG. 12 is a side view of a fourth suspension system for a boat.

FIG. 12 is like FIG. 11 except that the accommodation unit 8 shown in FIG. 12 has three rows of seats 46 behind the driver 48 rather than two rows of seats 46 behind the driver 48 as shown in FIG. 11. Also, the accommodation unit 8 has a bottom 52 which is of a toothed construction, whereas the bottom 52 in the accommodation unit 8 shown in FIG. 11 is of a flat construction. Also, the rear of the accommodation unit 8 shown in FIG. 12 has an upstanding back portion 54.

Figure 13:
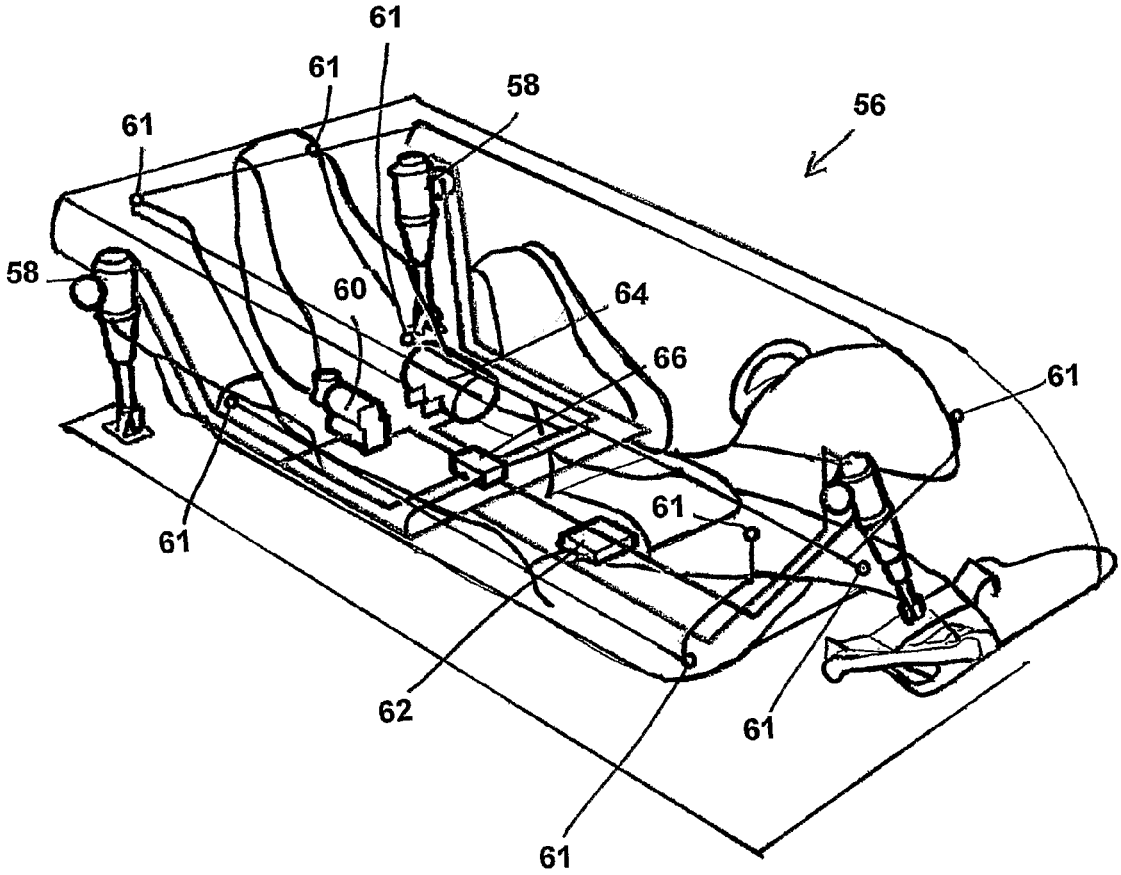
FIG. 13 is a circuit diagram of a suspension system for a boat.

FIG. 13 shows a suspension system 56 in which similar parts as in previous Figures have been given the same reference numerals. The suspension system 56 comprises suspension means and electronic control means for the suspension means. The suspension means comprises actuators 58, a compressor 60, an air reservoir 64 and a distribution lock 66. The electronic control means comprises sensors 61 and computer means 62. The sensor means 61 senses dynamic forces on the hull of the boat. The computer means 62 is for receiving input signals derived from the sensed dynamic forces, and for providing response signals for the suspension means in order to cause the suspension means to provide optimum ride conditions for the person when the boat is travelling through the water.

Figure 14:
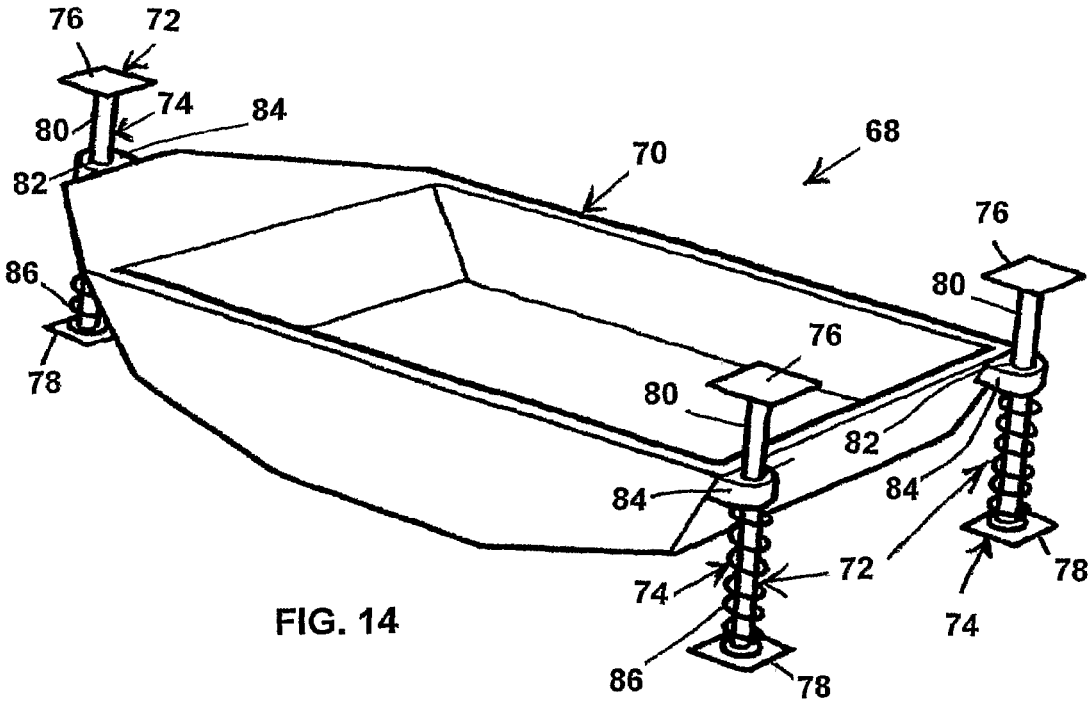
FIG. 14 is a perspective view of a fifth suspension system for a boat.

Referring now to FIG. 14, there is shown a perspective view of a fifth suspension system 68 for a boat. The suspension system 68 comprises a single accommodation unit 70 for at least one person travelling on the boat, and suspension means 72 for providing suspension unit for the accommodation unit 70 with respect to the hull of the boat. The suspension system 72 is a three-point suspension system having three similar suspension devices 74 positioned as shown. Each suspension device 74 comprises an upper mounting plate 76 and a lower mounting plate 78. A rod 80 extends between the mounting plates 76, 78 and also passes through an aperture 82 in a location member 84 which locates the rod 80 to the accommodation unit. The rod 80 can slide through its location member 84. Each suspension device 74 has a coil spring 86 extending between the lower mounting plate 78 and the location member 84. The coil spring 86 enables controlled up and down movement of the accommodation unit 70 with respect to the hull of the boat.

Figure 15:
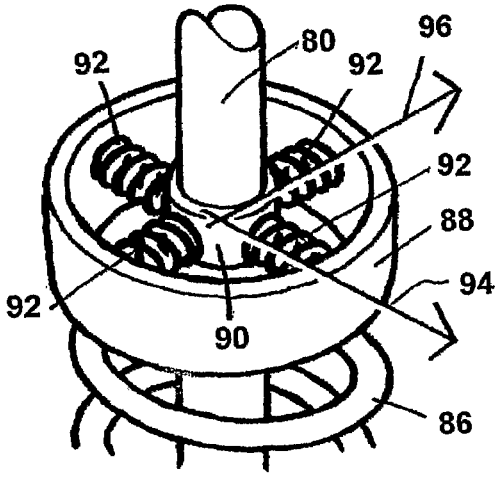
FIG. 15 is a perspective view of part of the suspension shown in FIG. 14.

As shown in FIG. 15, the location member 84 includes a collar 88 and a sleeve 90. The rod 80 is able to slide through the sleeve 90. Four coil springs 92 are positioned as shown between the sleeve 90 and the inside of the collar 88. These permit controlled damped movement forward and aft as shown by the arrow 94 and side ways as shown by the arrow 96.

Figure 16:
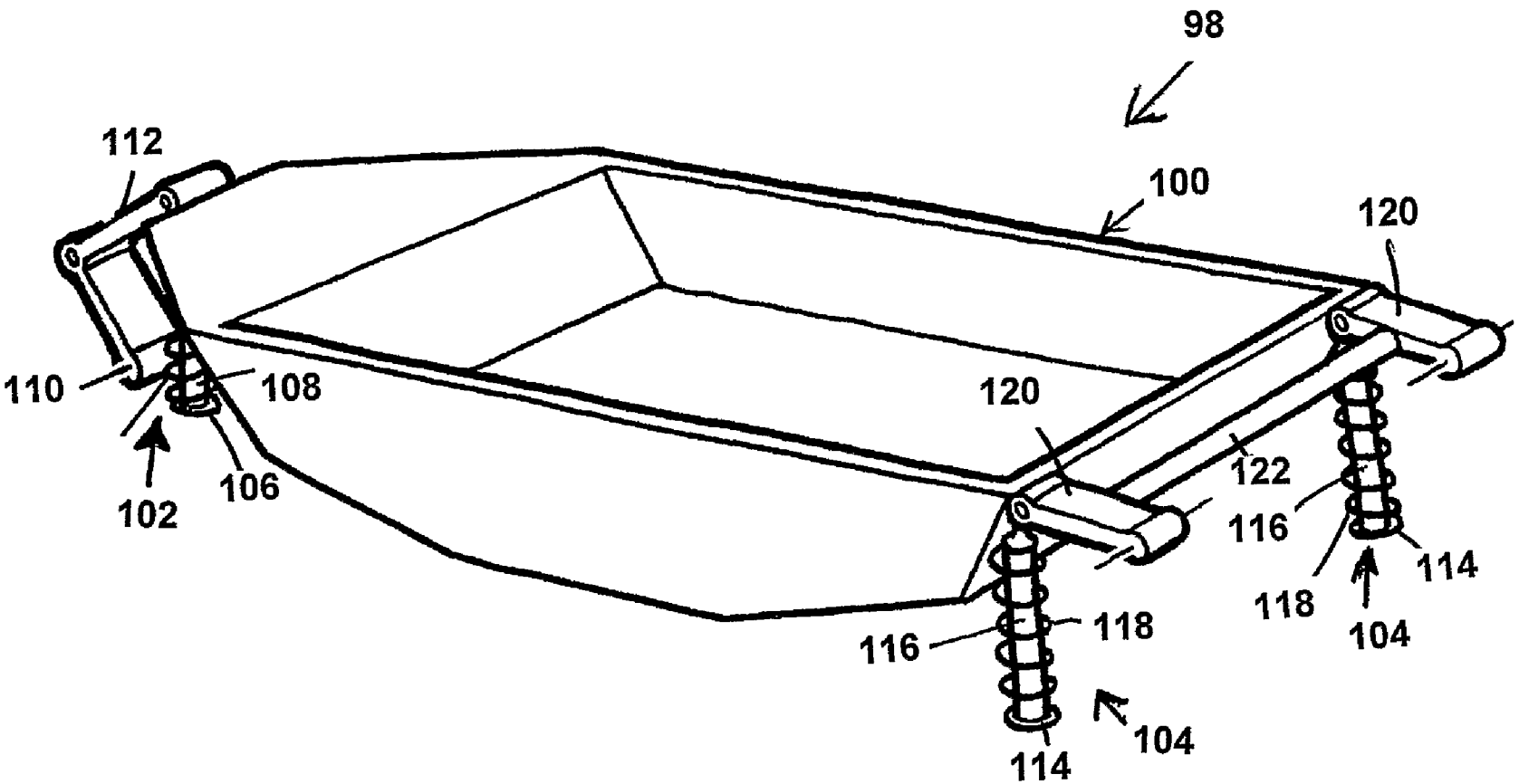
FIG. 16 is a perspective view of a sixth suspension system for a boat.
Figure 20:
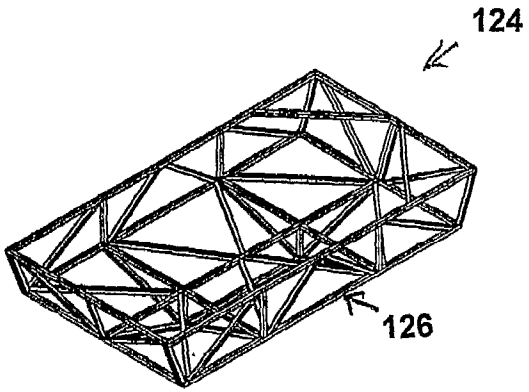
FIGS. 17, 18, 19 and 20 are top plan, side, front and part perspective views of a seventh suspension system for a boat.
Figure 19:
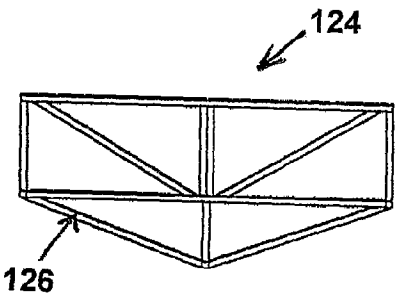

FIG. 16 shows the sixth suspension system 98 for a boat. The suspension system 98 is for mounting to a hull of the boat and the suspension system 98 comprises a single accommodation unit 100 for at least one person travelling on the boat. The suspension system 98 also comprises suspension means 102 provided at a front part of the accommodation unit 100, and suspension means 104 provided at two corners of a rear part of the accommodation unit. The suspension means 102 comprises a mounting plate 106, a rod 108 and a coil spring 110. The bottom of the coil spring 110 abuts against the mounting plate 106. The top of the coil spring engages with a front shackle 112. The suspension means 104 comprise a mounting plate 114, a rod 116, a coil spring 118 and an upper shackle 120. The two upper shackles 120 are connected by a connecting bar 122.

Figure 17:
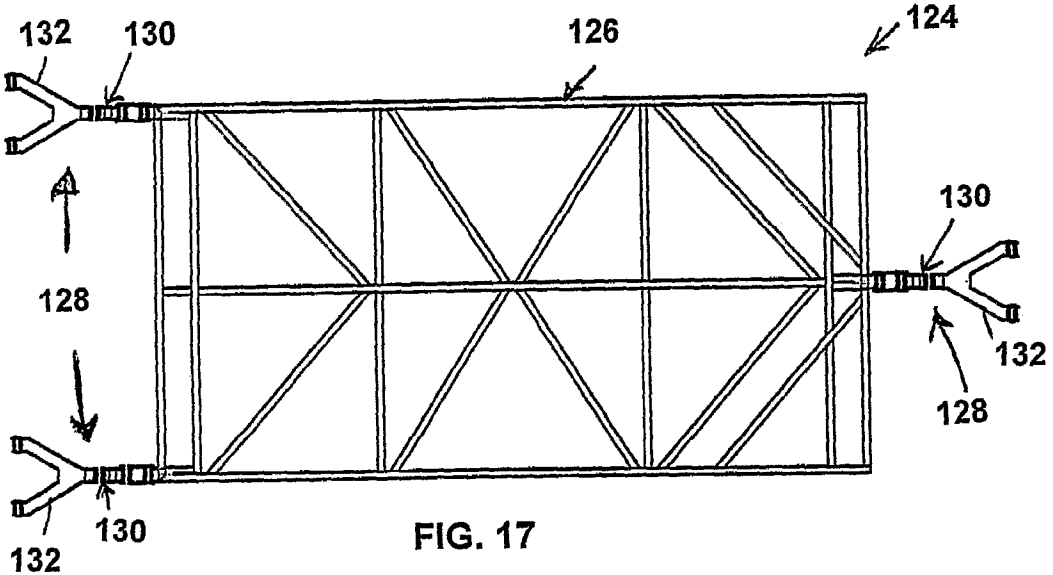
Figure 18:
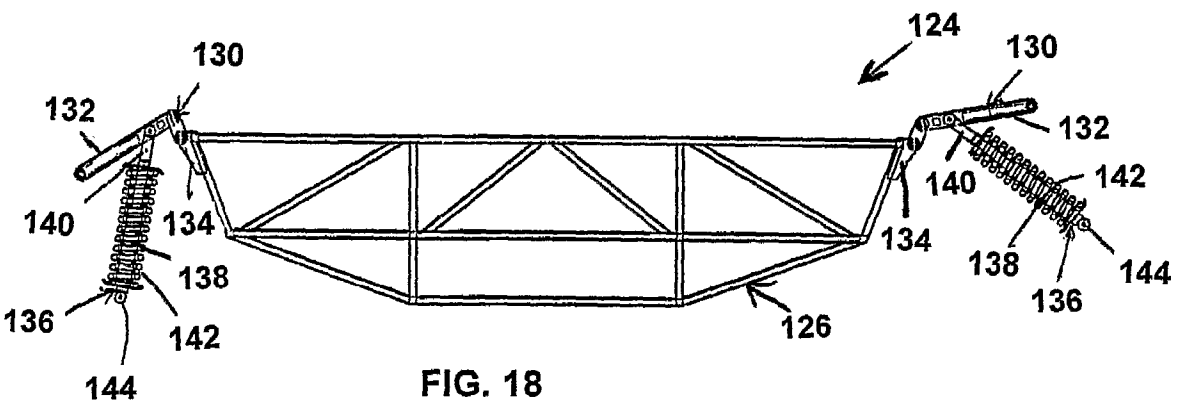

FIGS. 17-20 show a seventh suspension system 124 for mounting to a hull of a boat. The suspension system 124 comprises a frame 126 which is made of bars as shown and which defines the shape of an accommodation unit. The suspension system 124 also comprises suspension means 128 for providing suspension for the accommodation unit with respect to the hull of the boat. The suspension means 128 is a three-point suspension means 128 comprising two suspension devices 130 positioned at a rear part of the accommodation unit, and a single suspension device 130 positioned in the middle of a front part of the accommodation unit. FIG. 17 illustrates how the suspension devices 30 have a V-shaped portion 132 for mounting to an appropriate part of the hull of the boat. FIG. 18 shows how the suspension devices 130 are connected by a connecting part 134 to the frame 126. FIG. 18 also illustrates how the suspension devices 30 comprise a shock absorber 136 comprising a cylinder 138, a piston rod 140 and a coil spring 142. The shock absorber 136 has an aperture 144 for enabling it to be connected to an appropriate anchor device on the hull of the boat. The side sectional shape of the frame 126 is best appreciated from FIG. 18. The front sectional shape of the frame 126 is best appreciated from FIG. 19.

FIG. 21 shows an eighth suspension system 146. The suspension system 146 is similar to the suspension system 124 insofar as the suspension system 146 has a frame 148 composed of rods, and suspension means 150 formed by four of the suspension devices 130.

FIG. 22 shows the suspension system 146 of FIG. 21 in more detail and installed in a boat 152. In FIG. 22, the frame 148 has been provided with an accommodation unit 154. The four suspension devices 130 are shown positioned at the four corners of the frame 148 and therefore at the four corners of the accommodation unit 154. As can be clearly seen from FIG. 22, the suspension system 146 is such that it comprises only a single accommodation unit 154 for at least one person travelling on the boat, and the suspension means 150.

FIGS. 23 and 24 show the operating principle of a ninth suspension system 156 for mounting to the hull of a boat. The suspension system 156 comprises a single accommodation unit 158 for at least one person travelling on the boat, and suspension means 160 for providing suspension for the accommodation unit 158 with respect to the hull of the boat. The suspension means 160 comprises three suspension devices 162. There is one suspension device 162 arranged at a front part of the accommodation unit 158, and there are two of the suspension devices 162 arranged at a rear part of the accommodation unit 158. The suspension devices 162 comprise a shackle 164 and a spring 166. The spring may in principle be a coil spring, a shock absorbing unit or any other suitable and appropriate spring means. FIG. 24 illustrates how the suspension device 162 is able to move in an arc 168.

FIG. 25 shows in more detail the suspension system 156 shown in FIGS. 23 and 24. In FIG. 25, the construction of the accommodation unit 158 is shown. Similarly, the construction of the suspension devices 162 is shown. The front suspension device 162 comprises a shackle 170, a rod 172, a coil spring 174 and a mounting plate 176. The rod 172 connects to the shackle 170. In contrast, the rear suspension devices 162 are such that the rods 172 and the coil springs 174 are positioned at the rear corners of the accommodation unit 158 whilst a shackle 170 is positioned between the two rods 172 as shown.

FIG. 26 shows in more detail the suspension system 156 shown in FIG. 25. The suspension system 156 is shown mounting in a boat 178. The centrally mounted rear shackle 170 is shown in detail, together with mountings 180 to a hull part 182 of the boat 178. The construction and operation of the front suspension device 162 is also shown in more detail. It can be seen from FIG. 26 that the actual construction of the front suspension device 162 comprises a spring device 184 and a shackle 186 which is connected at two points 188, 190 to the accommodation unit 158. In FIG. 25, the suspension devices 162 have been shown as comprising a coil spring 174 positioned around a rod 172. In FIG. 26, the front suspension device 162 is shown as comprising a more sophisticated piston and cylinder suspension arrangement 184 at both the front and the rear of the accommodation unit 158.

FIG. 27 shows schematically an eleventh suspension system 192 for mounting in the hull of a boat. The suspension system 192 comprises a single accommodation unit 194 and suspension means 196. The suspension means 196 comprises a front suspension device 198 which is composed of three rods 200, 202, 204 as shown. The rear suspension device 196 comprises a single rod 206 as shown. The front suspension means 196 may alternatively be what is known as a watts linkage. The rods may be those known as panhard rods.

FIGS. 28 and 29 show side and top views respectively of an accommodation unit 208 provided with two side rods 210 and an underneath rod 212. The rods may be panhard rods.

FIGS. 30 and 31 show an alternative construction to that shown in FIGS. 28 and 29. In FIGS. 30 and 31, an accommodation unit 214 has front and rear transversely extending panhard rods 216. FIG. 31 illustrates how the rods 216 can control centre of gravity height.

Figure 2:
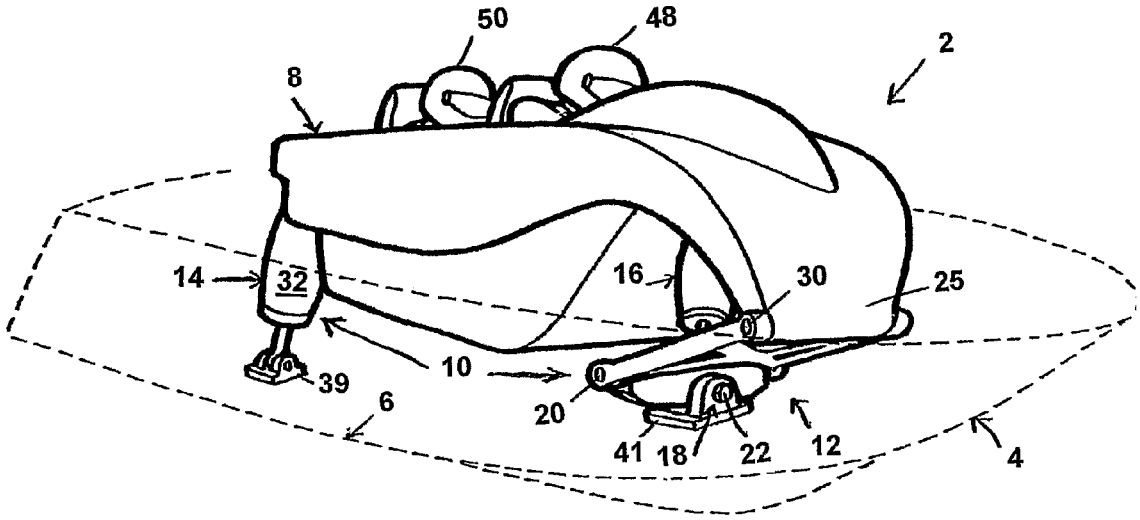
FIG. 2 is a view from the front and the other side of the suspension system shown in FIG. 1 and without the boat.
Figure 3:
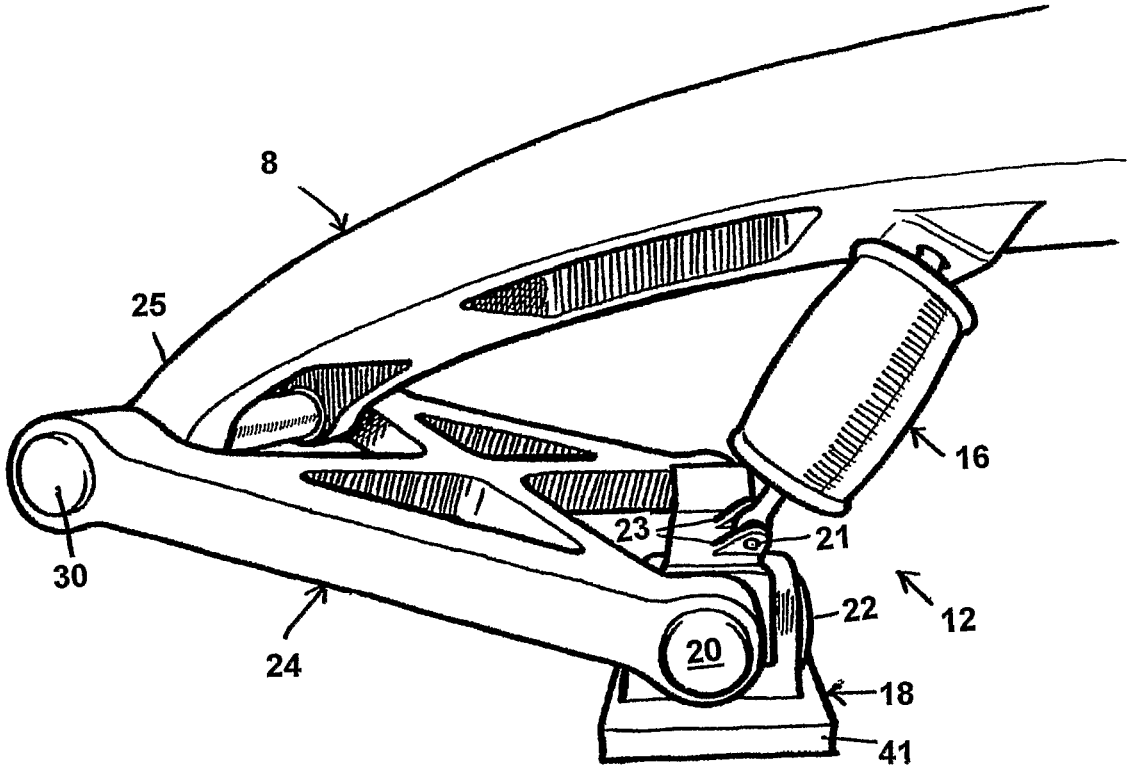
FIG. 3 is a perspective view from the rear and one side of front suspension means forming part of suspension means used in the suspension system shown in FIGS. 1 and 2.
Figure 4:
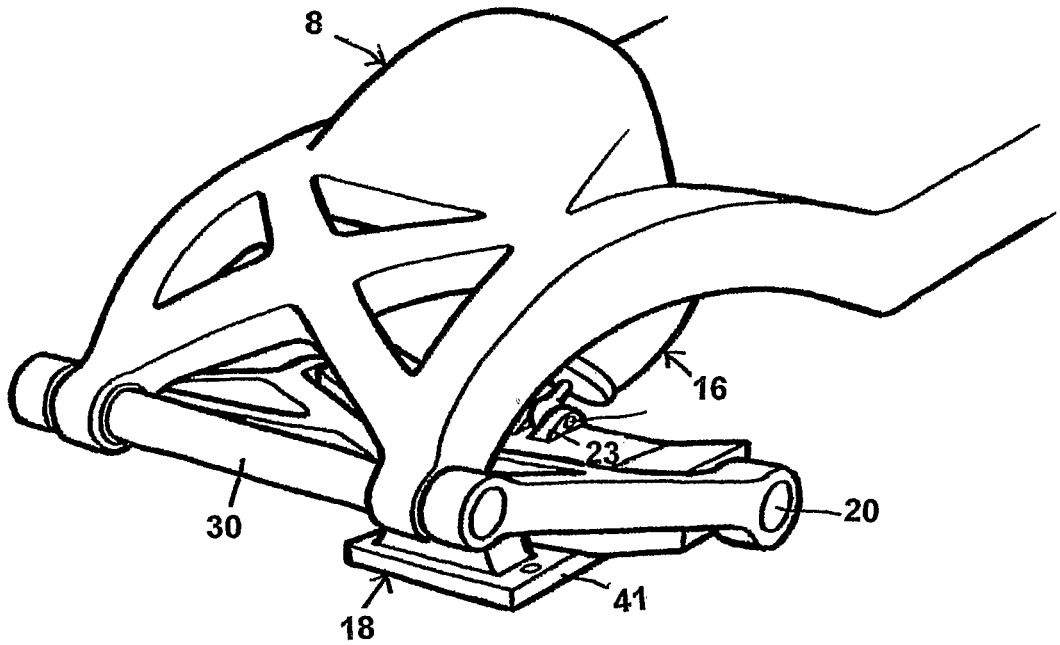
FIG. 4 is a view from the front and one side of the front suspension means shown in FIG. 3.
Figure 5:
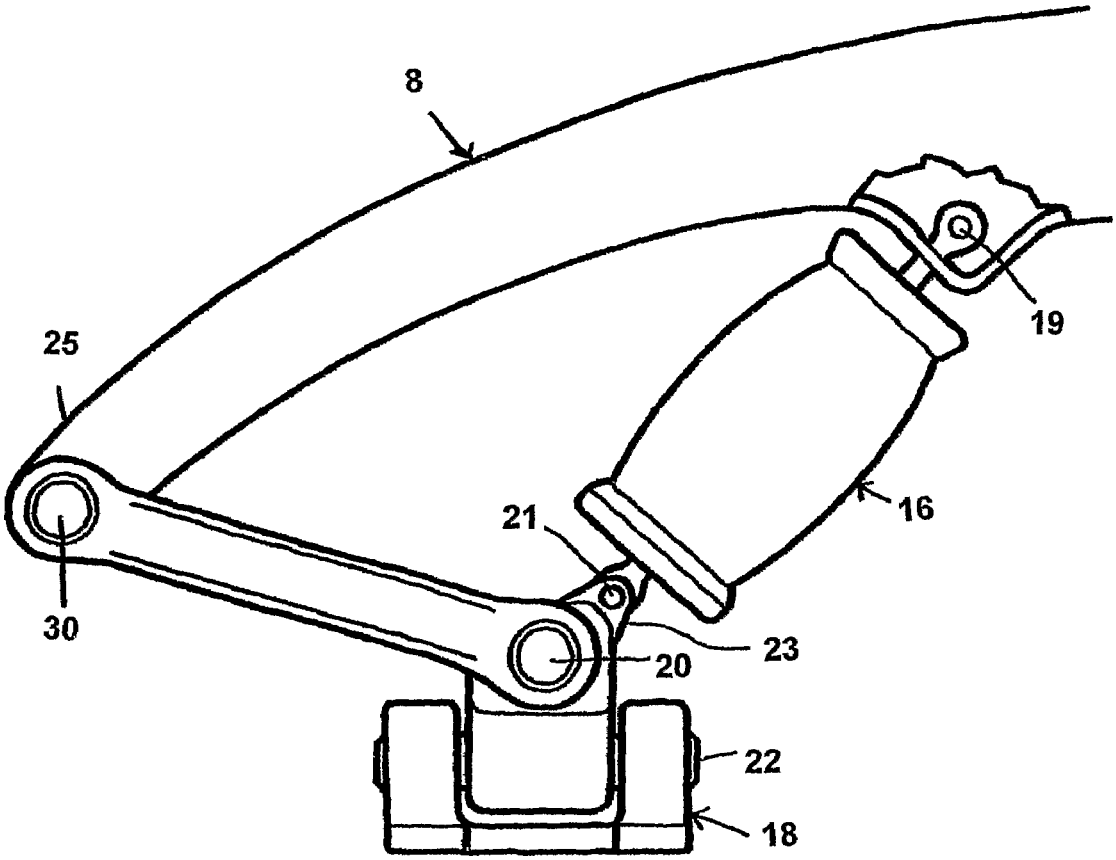
FIG. 5 is a side view of the front suspension means shown in FIG. 3.

FIG. 32 shows schematically a thirteenth suspension system 218 for mounting to a hull of a boat. The suspension system 218 comprises a single accommodation unit 220, and suspension means 222 for providing suspension for the accommodation unit 220 with respect to the hull of the boat. As shown in FIG. 2, the accommodation unit 220 may receive slam loads shown by arrows 224, and it may receive stuff loads shown by arrows 226. Resultant loads are shown by arrows 228 and 230.

FIG. 33 illustrates the angle of attack that the accommodation unit 218 will have with respect to water during use.

FIG. 34 shows a fourteenth suspension system 232 mounted to a hull 234 of a boat 236. The boat 236 has an outboard motor 238 and an open back 240 as shown. The suspension system 232 comprises a single accommodation unit 242 containing seven persons 244 as shown. The persons 244 are seated in seats 246 which are mounted to the accommodation unit 242. The suspension system 232 includes suspension means 248 as shown for providing suspension for the accommodation unit 242 with respect to the hull 234 of the boat 236. In an alternative embodiment of the invention (not shown), the outboard motor 238 could be an inboard motor.

FIG. 35 shows schematically a fifteenth suspension system 250 mounted to a hull 252 of a boat 254. The suspension system 250 has a single accommodation unit 256 which is shown schematically mounted on springs 258. The springs 258 form the suspension means for providing suspension for the accommodation unit 256 with respect to the hull 252 of the boat 254. The boat 254 is shown provided with propulsion means in the form of an outboard motor 260. The motor could also be an inboard motor if desired. Persons 262 are shown seated in seats 264 in the accommodation unit 256. The suspension system 250 shown in FIG. 30 may operate to provide lower loads and lower pressures on the hull 252. Thus, for example, for a total weight of 1000 Kgs formed by the accommodation unit 256 and the persons 262, only 300 Kgs may be exerted on the hull 252.

FIG. 36 shows a sixteenth suspension system 266 mounted to a hull 268 of a boat 270. The suspension system 266 comprises a single accommodation unit 272 having two seats 274 for two persons. The suspension system 266 comprises suspension means 276 at the front and the back of the accommodation unit 272. The rear part of the suspension means 276 is the same as the rear part of the suspension means 162 shown in FIG. 26. Similarly, the front part of the suspension means 276 is the same as the front part of the suspension means 162 shown in FIG. 26. The boat 270 is shown provided with a forwardly facing gun 278 and a rearwardly facing gun 280. The boat 2 is also shown provided with a steering wheel 282 for use by the person occupying the right hand seat 274 as shown in FIG. 36. The boat 270 has two outboard motors 284. The motors 284 could alternatively be inboard motors if desired.

Figure 41:
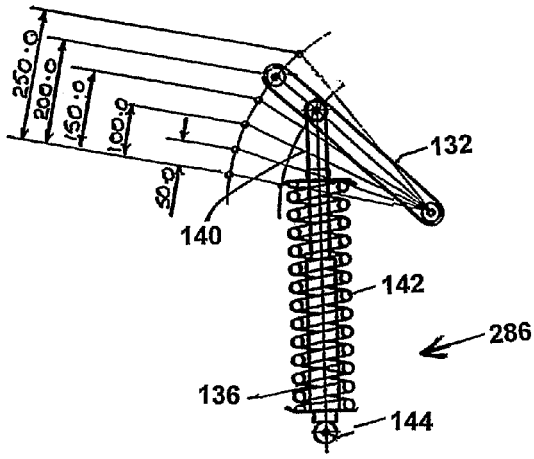

FIGS. 37-41 show the construction and operation of suspension means 286 forming part of a suspension system in accordance with the present invention. The suspension means 236 is the same as the suspension means 130 shown in FIGS. 17 and 18. Similar parts as in FIGS. 17 and 18 have been given the same reference numerals for ease of comparison and understanding. FIG. 41 shows different heights that can be achieved using the suspension means 286.

The suspension system of the present invention can be made from a wide variety of materials including modern lightweight strong materials such for example as carbon fibre, Kevlar and plastics materials.

It is to be appreciated that the embodiments of the invention described above with reference to the accompanying drawings have been given by way of example only and that modifications may be effected. Thus, for example, the suspension system of the present invention may include means for raising and lowering the accommodation unit. The suspension system may also include first control means for enabling adjustment of the accommodation unit as dictated by water conditions. The suspension system may also include second control means which is for connection to an engine of the boat for increasing or decreasing power output from the engine in order to control rigidity of the suspension system, for example by generating more or less air for airbags forming part of the front and rear suspension means.

The suspension system of the present invention may have power generation in the form of a hydraulic accumulator which generates electricity and which is appropriately stored in one or more batteries.

Where a weapons platform is employed such for example as shown in FIG. 36, then the weapons platform may be giro-controlled. The suspension system of the present invention may make use of magnetronic shocks. The suspension system may utilise a modular tank seat. The suspension of the present invention and the boat may use an on-board pay-load weighing means.

The invention claimed is:

1. A suspension system for a boat, which suspension system is for mounting to a hull of the boat, and which suspension system comprises a single accommodation unit for at least one person travelling on the boat, and suspension means for providing suspension for the accommodation unit with respect to the hull of the boat; the suspension system being such that it prevents or reduces shocks to the hull caused by the boat travelling through the water from being transmitted to the accommodation unit; the suspension system being such that enables weight transfer between the accommodation unit and the hull for enhancing handling and ride characteristics of the boat; and the suspension system being such that it comprises at least one joint arrangement which allows rotational and vertical movement and which comprises first pivot means for securing the hull, second pivot means for securing the accommodation unit, third pivot means positioned between the first and the second pivot means, a first member which is of a fixed length and which extends between the first and the third pivot means, and a second member which is of a fixed length and which extends between the second and third pivot means.

2. A suspension system according to claim 1 and including electronic control means for controlling operation of the suspension means.

3. A suspension system according to claim 2 in which the electronic control means comprises sensor means for sensing dynamic forces on the hull, and computer means for receiving input signals derived from the sensed dynamic forces and for providing response signals for the suspension means in order to cause the suspension means to provide optimum ride conditions for the person when the boat is travelling through the water.

4. A suspension system according to claim 1 in which the suspension means comprises front suspension means and rear suspension means.

5. A suspension system according to claim 4 in which the front suspension means comprises at least one front shock absorbing device for permitting up and down movement of the accommodation unit for absorbing up and down shocks, and a multi-axis joint for permitting side to side movement of the accommodation unit and thereby absorbing sideways shocks.

6. A suspension system according to claim 5 in which the front shock absorbing device is an airbag.

7. A suspension system according to claim 4 in which the front shock absorbing device extends at an angle to the vertical.

8. A suspension system according to claim 5 in which there are two of the front shock absorbing devices, there being one of the front shock absorbing devices on either side of the accommodation unit.

9. A suspension system according to claim 5 in which the multi-axis joint is a double joint.

10. A suspension system according to claim 4 in which the rear suspension means comprises at least one rear shock absorbing device.

11. A suspension system according to claim 10 in which the rear shock absorbing device is an airbag.

12. A suspension system according to claim 10 in which the rear shock absorbing device extends substantially vertically.

13. A suspension system according to claim 10 in which the rear shock absorbing device is connected directly to the hull during use of the suspension system.

14. A suspension system according to claim 10 in which there are two of the rear shock absorbing devices, there being one of the rear shock absorbing devices on either side of the accommodation unit.

15. A suspension system according to claim 1 and which is of a modular construction for enabling a plurality of units of the suspension system to be connected together.

16. A suspension system according to claim 1 and including means for raising and lowering the accommodation unit.

17. A suspension system according to claim 1 and including springs which are variable rate springs.

18. A boat when provided with a suspension system according to claim 1.

* * * * *